US007832994B2

(12) United States Patent
Akashi et al.

(10) Patent No.: US 7,832,994 B2
(45) Date of Patent: Nov. 16, 2010

(54) HERMETIC-TYPE COMPRESSOR

(75) Inventors: Hironari Akashi, Chigasaki (JP); Kosuke Tsuboi, Chigasaki (JP)

(73) Assignee: Panasonic Corporation, Osaka (JP)

( * ) Notice: Subject to any disclaimer, the term of this patent is extended or adjusted under 35 U.S.C. 154(b) by 446 days.

(21) Appl. No.: 10/570,772

(22) PCT Filed: Oct. 12, 2004

(86) PCT No.: PCT/JP2004/015348

§ 371 (c)(1),
(2), (4) Date: Mar. 3, 2006

(87) PCT Pub. No.: WO2005/035984

PCT Pub. Date: Apr. 21, 2005

(65) Prior Publication Data

US 2006/0269428 A1 Nov. 30, 2006

(30) Foreign Application Priority Data

Oct. 14, 2003 (JP) ..... 2003-353463

(51) Int. Cl.
*F04B 17/00* (2006.01)

(52) U.S. Cl. ..... 417/415; 417/902; 184/6.6

(58) Field of Classification Search ..... 417/415, 417/902; 184/6.5, 6.6; 384/322, 397, 404, 384/415

See application file for complete search history.

(56) References Cited

U.S. PATENT DOCUMENTS 2,583,583 A 1/1952 Mangan
4,174,927 A * 11/1979 Lindstrom ..... 417/372
4,236,879 A * 12/1980 Abe ..... 417/368
5,022,146 A * 6/1991 Gannaway et al. ..... 29/888.02
5,078,573 A * 1/1992 Peroaho et al. ..... 415/169.1
5,088,297 A * 2/1992 Maruyama et al. ..... 62/228.4
5,795,140 A 8/1998 Jin
5,884,727 A * 3/1999 Ryu ..... 184/6.3
5,950,307 A * 9/1999 Lee ..... 29/888.02
5,971,724 A * 10/1999 Choi ..... 417/415
7,144,229 B2 * 12/2006 Ishida et al. ..... 417/415
7,367,784 B2 * 5/2008 No et al. ..... 417/372
2002/0170301 A1 11/2002 Loprete et al.
2004/0191094 A1 * 9/2004 Kojima et al. ..... 417/415

FOREIGN PATENT DOCUMENTS

JP 52-139407 U 10/1977
JP 2000-110723 A 4/2000
WO WO-03/008805 A 1/2003
WO WO 03008805 A1 * 1/2003
WO WO-03/012297 A 2/2003

* cited by examiner

*Primary Examiner*—Devon C Kramer
*Assistant Examiner*—Todd D Jacobs
(74) *Attorney, Agent, or Firm*—Harness, Dickey & Pierce, P.L.C.

(57) ABSTRACT

A hermetic-type compressor according to the present invention has a viscous pump part by combining a spiral groove formed on the outer periphery of a main shaft with the inner periphery of a main shaft bearing, and at least one sliding section being in a sliding engagement with the main shaft bearing and at least one non-contact sliding-section having a predetermined gap with the main shaft bearing are formed on the face at the outer periphery of the main shaft opposing to the main shaft bearing where the lower end of the groove is located at the non-contact sliding-section.

12 Claims, 6 Drawing Sheets

HERMETIC-TYPE COMPRESSOR

TECHNICAL FIELD

The present invention relates to a hermetic-type compressor provided in a refrigerating cycle in such an apparatus as refrigerators, air conditioners and the like.

BACKGROUND ART

In recent years, for the hermetic-type compressor provided in the refrigerating cycle, to reduce the noise in the operation and to reduce the power consumption have strongly been desired on the assumption that the hermetic-type compressor should have high reliability. In order to meet such demand, some progresses have been made to lower rotational frequency of the compressor by driving it with an inverter and to lower viscosity for the lubricant oil to be used. In the case of performing a low-speed operation of such compressor using lubricant oil having low viscosity, it is an important task to supply the lubricant oil certainly to the sliding portions in the compressor. Namely, as such task for the recent hermetic-type compressors, it is an improvement in the reliability of the sliding portions by certainly supplying lubricant oil. In order to achieve the task, an oil pump for supplying lubricant oil to the sliding portions has been already improved in some conventional hermetic-type compressor. As such conventional hermetic-type compressor, there is one example disclosed in the Official Gazettes of Japanese Unexamined Patent Publication No. 2000-110723.

In the following paragraphs, the conventional hermetic-type compressor disclosed in the Official Gazettes of Japanese Unexamined Patent Publication No. 2000-11023 will be explained with reference to FIG. 6 of the appended drawings.

FIG. 6 is a longitudinal cross-sectional view illustrating an inner structure of the conventional hermetic-type compressor. As shown in FIG. 6, an electric motor part 4 composed of a stator 2 and a rotor 3, and a compressor part 5 to be driven by the electric motor part 4 are contained in a hermetically sealed container 1. In the hermetically sealed container 1, a lubricant oil 6 is reserved.

A crank shaft 7, which serves to transmit the rotational driving force of the electric motor part 4 to the compressor part 5, has a main shaft 8 to which the rotor 3 is press-fit to be fixed and a crank part 9 formed on the main shaft 8. The crank part 9 is formed eccentrically with respect to the rotational center axis of the main shaft 8. A cylinder block 14 in the compressor part 5 includes a compressing chamber 15 having approximately cylindrical shape as well as a main shaft bearing 16 which rotatably supports the main shaft 8. On the outer periphery of the main shaft 8, there are provided two sliding sections 17, 17, being in a sliding engagement with the main shaft bearing 16 at its upper and lower parts, and a non-sliding section 18 which does not contact to slide with the main shaft bearing 16, and which is formed between the sliding parts 17,17.

In the compressor part 5, a piston 19 is inserted in the compressing chamber 15 of the cylinder block 14, being permitted of a reciprocating sliding movement in the chamber. The piston 19 is connected to the crank part 9 of the crank shaft 7 with a connecting rod 20.

In the crank shaft 7, an oil supplying path 30 is formed inside the main shaft 8 and another oil supplying path 31 is formed from the upper potion of the main shaft 8 to the crank part 9. On the outer periphery of the main shaft 8, there is formed a spiral groove 32 which inclines upwards in a direction reverse to the rotational direction of the crank shaft 7. An lower end of the spiral groove 32 communicates with the oil supplying path 30 at the vicinity of its upper end. An upper end of the spiral groove 32 communicates with the other oil supplying path 31 at the vicinity of its lower end. On the lower end of the main shaft 8, there is fixed an oil pump 33 whose one end opens in the lubricant oil 6 and whose another end communicates with the oil supplying path 30.

Next, the operation of the above-mentioned conventional hermetic-type compressor will be hereinafter described.

The crank shaft 7 rotates with the rotational movement of the rotor 3 of the electric motor part 4, and its crank part 9 performs a revolving movement about the center axis of the main shaft 8. The revolving movement of the crank part 9 is converted into a reciprocating movement with the connecting rod 20 to be transmitted to the piston 19. As a result, the piston 19 performs a reciprocating sliding movement within the compressing chamber 15, thereby to suck a refrigerant gas into the compressing chamber 15 to be compressed. In this manner, the refrigerant gas in the refrigerating system is, after being sucked into the compressing chamber 15 to be compressed therein, is then exhausted outside the hermetically sealed container for a further circulation through the refrigerating system.

The oil pump 33 provided on the lower end of the crank shaft 7 performs a pumping action of pumping up the lubricant oil 6 by the rotation of the crank shaft 7. By the pumping action of the oil pump 33, the lubricant oil 6 reserved in the bottom portion of the hermetically sealed container 1 ascends through the oil supplying path 30 in the main shaft 8. The lubricant oil 6 reached the upper portion of the oil supplying path 30 is led to the spiral groove 32. Since the spiral groove 32 inclines in the same direction of an inertia force which acts in a direction reverse to the rotational direction of the crank shaft 7, an upward transporting force acts on the lubricant oil 6 in the groove 32. As a result, the lubricant oil 6 ascends along the groove 32 and is supplied to the sliding section 17 of the crank shaft 7. And the lubricant oil 6 reached the upper end of the spiral groove 32 is led to the other oil supplying path 31 to be supplied to the sliding components of the crank part 9 and the compressor part 5.

In the conventional hermetic-type compressor structured in the above-mentioned manner, there is the case wherein minute dust and refuses generated during the assembling process may enter the lubricant oil 6. The minute dust and refuses sucked up with the lubricant oil 6 by the oil pump 33 ascend through the oil supplying path 30 by centrifugal force. Since the oil supplying path 30 is formed in the main shaft 8 along a perpendicular line which is eccentric with respect to the center line of the main shaft 8, the minute dust and the like ascend through the oil supplying path 30 along its outer peripheral side. And the minute dust and the like are thrown away at the vicinity of the oil supplying path 30 towards the direction of the spiral groove 32 formed on the outer periphery of the main shaft 8 by centrifugal force. Namely, the direction of the stream of the lubricant oil 6 changes by approximately 90 degrees to the horizontal direction at the vicinity of the oil supplying path 30. For that reason, the minute dust and the like are easily collected around the vicinity of the lower end of the spiral groove 32 by centrifugal force and gravity. When the minute dust and the like are collected around the vicinity of the lower end of the groove 32, the minute dust and the like easily enter into the narrow gap between the sliding sections 17 of the crank shaft 7 and the main shaft bearing 16, which is a factor of hindering the smooth sliding movement. As a result, the input energy must be increased to obtain the desired output in the conventional hermetic-type compressor, thus inviting a decrease in the efficiency. In addition, there is a problem that the reliability lowers due to the damage at the sliding sections 17.

Moreover, in the case where the conventional hermetic-type compressor is driven by the inverter at a low-speed driving frequency not greater than that of the power source, when the minute dust and the like are thrown away at the vicinity of the lower end of the groove 32 towards its periphery by centrifugal force, they further tend to stagnate at the lower end of the groove 32 by gravity because the flow velocity of the lubricant oil 6 is slow. Therefore, in the case of driving the conventional hermetic-type compressor at a low speed, the minute dust and small refuses further easily enter into a narrow gap between the sliding sections 17 and the main shaft bearing 16, thus damaging the smooth sliding movement.

The present invention is proposed to solve the above-mentioned problems of the conventional hermetic-type compressor and intends to provide a hermetic-type compressor having a high efficiency and reliability. In the present invention, the expected smooth sliding movement is realized by structuring the compressor so that the lubricant oil can sufficiently be supplied to the sliding parts and components, and preventing the dust and the refuses from entering the sliding parts and components in the shaft portion.

DISCLOSURE OF INVENTION

In order to achieve the above-mentioned object, the present invention is a hermetic-type compressor including an electric motor part and a compressor part to be driven by the above-mentioned electric motor part both enclosed in a hermetically sealed container which reserves a lubricant oil, where the above-mentioned compressor part comprises a crank shaft having a crank part and a main shaft, which has an axis of rotation in a perpendicular direction, and a main shaft bearing for rotatably supporting the above-mentioned main shaft, a viscous pump is comprised by combining a groove, at least part of which being spiral, formed on the outer periphery of the above-mentioned main shaft, with the inner periphery of the above-mentioned main shaft bearing, at least one sliding section being in a sliding engagement with the above-mentioned main shaft bearing, and at least one non-contact sliding-section having a predetermined gap with the above-mentioned main shaft bearing are formed on the outer periphery of said main shaft which faces the above-mentioned main shaft bearing; and the lower end of the above-mentioned groove is arranged at the above-mentioned non-contact sliding-section.

With this configuration, in the hermetic-type compressor of the present invention, thus comprised, even if the minute dust and refuses sucked up with the lubricant oil are collected in the vicinity of the lower end of the spiral groove and entered into the gap between the non-contact sliding-section of the main shaft and the main shaft bearing, the minute dust and refuses will be exhausted from the gap without stagnating there, because the gap at the non-contact sliding-section is large. Therefore, the hermetic-type compressor according to the present invention can realize an apparatus of a high efficiency and a high reliability, by preventing the lowering of efficiency by the increase of the input and the lowering of reliability by the damage and the abrasion in the sliding sections.

The hermetic-type compressor according to the present invention may be constructed so that the lower end of the groove is located at the non-contact sliding-section below the sliding section where the main shaft is in a sliding engagement with the main shaft bearing. With the hermetic-type compressor of the present invention thus comprised, even if the minute dust and refuses sucked up with the lubricant oil are collected in the vicinity of the lower end of the groove and entered into the gap between the non-contact sliding-section of the main shaft and the main shaft bearing, the minute dust and refuses will not damage the main shaft and the main shaft bearing, because the gap at the non-contact sliding-section is large. Further, since it is possible to set the lift (distance) from the oil surface of the lubricant oil reserved in the bottom of the hermetically sealed container to the lower end of the groove at the bearing part to be short, the oil supply amount increases with the same rotational frequency and it is possible to perform a sufficient oil supply even at a low speed rotation. Therefore, according to the present invention, it is possible to improve the efficiency and the reliability, because the minute dust and refuses can be exhausted without damaging the main shaft and the main shaft bearing at the non-contact sliding-section, and at the same time, stabilized amount of the oil supply can be secured.

The hermetic-type compressor according to the present invention may be structured so that a plurality of non-contact sliding-sections are formed on the outer periphery of the main shaft facing with the main shaft bearing, and the gap between the main shaft and the main shaft bearing in the lowermost position of the non-contact sliding-section may be formed to be narrower than the gaps between the main shaft and the main shaft bearing at the other non-contact sliding-section. Since the lower part of the non-contact sliding-section is open in the thus structured hermetic-type compressor of the present invention, the minute dust and refuses can be exhausted through the lower part of the main shaft bearing by gravity. In addition, since it is possible to set the lift (distance) from the oil surface of the lubricant oil reserved in the bottom of the hermetically sealed container to the lower end of the groove at the bearing part to be short, the oil supply amount increases with the same rotational frequency and it is possible to perform a sufficient oil supplying operation at a low speed rotation.

In the hermetic-type compressor according to the present invention, it is preferable to set the diameter gap between the main shaft and the main shaft bearing at the non-contact sliding-section, at which the lower end of the groove is located, to be in a range between 0.05 mm and 0.40 mm. The hermetic-type compressor of the present invention, thus constructed, the lubricant oil does not easily leak downward from the lower end of the main shaft bearing as compared with the case where the gap at the non-contact sliding-section is too large, and thus, it is possible to perform the oil supplying operation sufficiently to the sliding portion such as the main shaft above the non-contact sliding-section, the crank part, and the like. In addition, it is also possible to make the input through viscous friction of the lubricant oil in the non-contact sliding-section decrease, as compared with the case where the gap at the non-contact sliding-section is too small.

Moreover, the upper end of the groove of the hermetic-type compressor according to the present invention may be located at the non-contact sliding-section above the sliding section where the main shaft is in the sliding engagement with the main shaft bearing. In the hermetic-type compressor according to the present invention thus comprised, an oil film of the lubricant oil can surely be formed at the sliding section where the main shaft is in the sliding engagement with the main shaft bearing.

Further, it is preferable for the hermetic-type compressor according to the present invention to set the diameter gap between the main shaft and the main shaft bearing at the non-contact sliding-section at which the upper end of the groove locates, to be in a range between 0.05 mm and 0.50 mm. With the hermetic-type compressor of the present invention thus comprised, it is possible to make the viscous friction at the non-contact sliding-section sufficiently small.

Moreover, the hermetic-type compressor according to the present invention may also be structured to further include an auxiliary shaft provided being coaxial with the main shaft and sandwiching the crank part, and an auxiliary bearing rotatably supporting the above-mentioned auxiliary shaft. In the thus comprised hermetic-type compressor according to the present invention, the auxiliary bearing regulates any inclination of the main shaft and the main shaft rotates around the axis in the substantially perpendicular direction.

Further, the hermetic-type compressor according to the present invention may have only one sliding section between the main shaft and the main shaft bearing. In the hermetic-type compressor of the present invention thus comprised, an oil film can surely be formed between the main shaft and the main shaft bearing, and the sliding loss can be reduced and the efficiency can be improved because the sliding area is minimized.

Moreover, the hermetic-type compressor according to the present invention may be structured to be driven by an inverter at a plurality of driving frequencies including those not greater than the commercial power source frequency. With the hermetic-type compressor of the present invention thus comprised, since reduction in the compressing load by the low driving frequencies can be realized, it is possible to lower the input to the hermetic-type compressor, and thus the power consumption of the refrigerating cycle in the refrigerator and the like can be greatly reduced.

While the novel features of the invention are set forth particularly in the appended claims, the invention, both as to configuration and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

BEST MODE FOR CARRYING OUT THE INVENTION

Preferred embodiments of a hermetic-type compressor according to the present invention will be hereinafter described referring to the appended drawings.

First Embodiment

Figure 1:
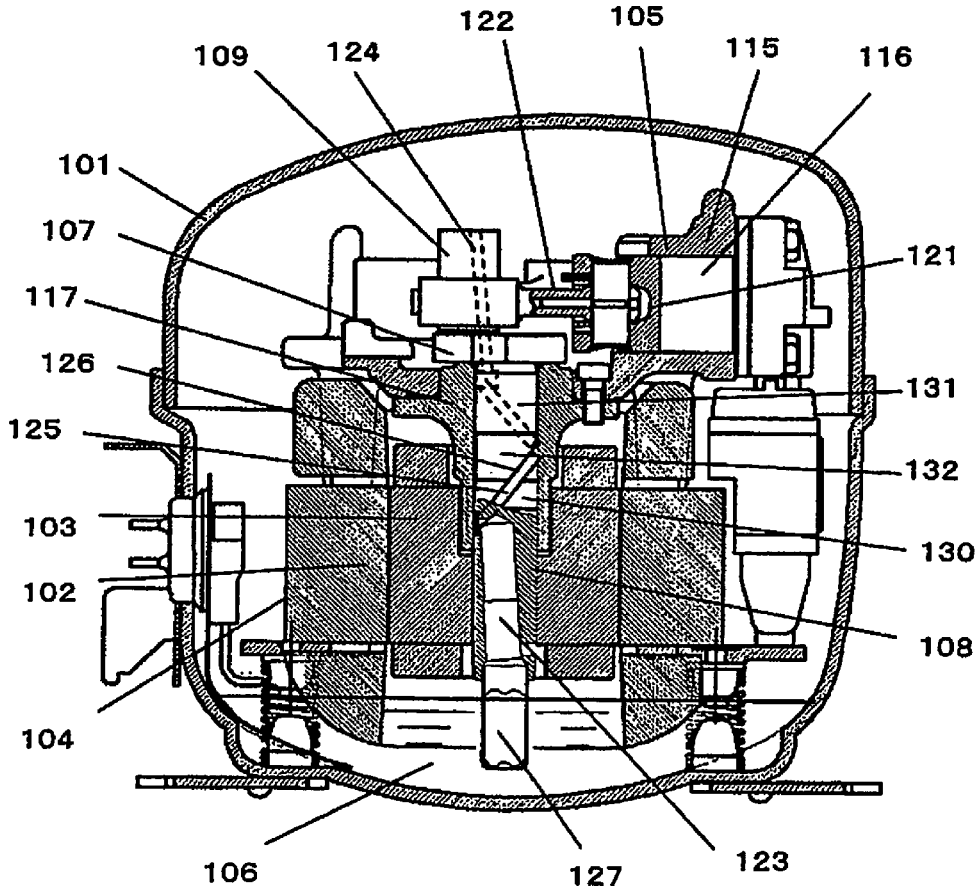
FIG. 1 is a longitudinal cross-sectional view illustrating an inner structure of the hermetic-type compressor of a first embodiment according to the present invention.
Figure 2:
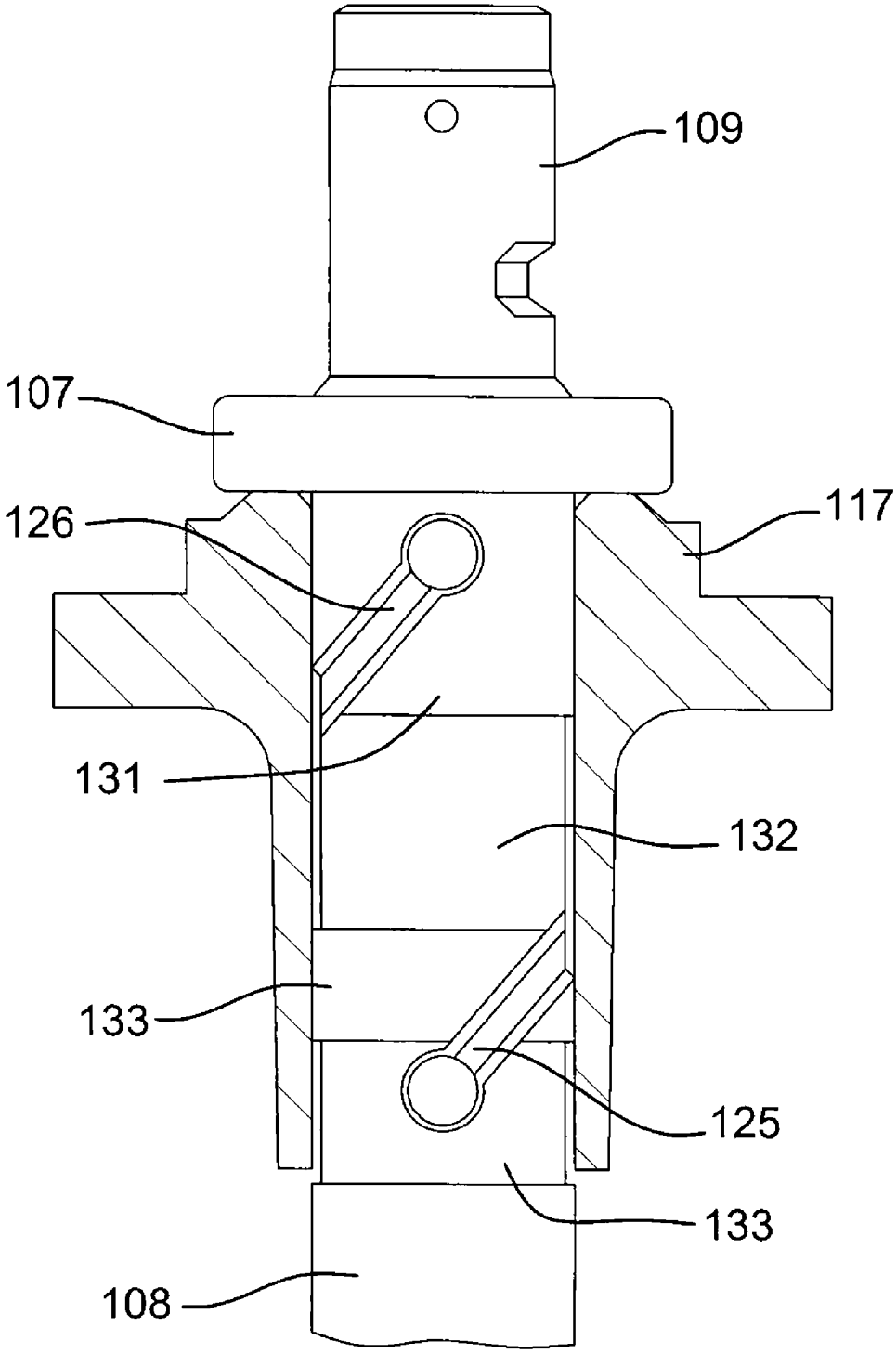
FIG. 2 is a cross-sectional view showing a relevant part of the hermetic-type compressor of the first embodiment.

FIG. 1 is a longitudinal cross-sectional view illustrating an inner structure of a hermetic-type compressor of a first embodiment according to the present invention. FIG. 2 is a cross-sectional view showing the relevant part of the hermetic-type compressor of the first embodiment.

As shown in FIG. 1 and FIG. 2, an electric motor part 104 comprising a stator 102 and a rotor 103 and a compressor part 105 to be driven by this electric motor part 104 are provided in a hermetically sealed container 101. The hermetically sealed container 101 reserves lubricant oil 106 therein.

A crank shaft 107 which transmits the rotational driving force of the electric motor part 104 to the compressor part 105 comprises a main shaft 108, around which the rotor 103 is press-fit to be fixed, having an axis of rotation along a perpendicular line, and a crank part 109 being formed in an eccentric manner with respect to the center axis of rotation of the main shaft 108. A cylinder block 115 in the compressor part 105 has a compressing chamber 116 of approximately cylindrical shape as well as a main shaft bearing 117 which rotatably supports the main shaft 108. On the outer periphery of the main shaft 108, there are provided two sliding sections 130, 131 being in a sliding engagement with the main shaft bearing 117 at its upper part and lower part as well as two non-contact sliding-sections 132, 133 formed below the sliding sections 130, 131, respectively (See FIG. 2). The diameters of the non-contact sliding-sections 132,133 are selected to be smaller than the diameters of the sliding sections 130, 131. Therefore, the crankshaft 107 is rotatably supported within the main shaft bearing 117 by the sliding sections 130, 131 formed on the main shaft 108.

By the rotational movement of the main shaft 108, the crank part 109 of the crank shaft 107, being eccentric to the main shaft 108, performs a rotational movement about the rotational axis of the main shaft 108, and converts the rotational movement into a reciprocating movement by a connecting rod 122 connected to the crank part 109. The crank part 109 is connected to a piston 121 in the compressor part 105 through the connecting rod 122. As a result, the rotational movement of the crank shaft 107 causes the piston 121 to perform a reciprocating sliding movement in the compressing chamber 116 of a cylinder block 115.

Inside the crank shaft 107, there are formed a first oil supplying path 123 and a second oil supplying path 124. The first oil supplying path 123 inside the lower end part of the main shaft 108 is formed in an inclined manner. Namely, the lower end of the first oil supplying path 123 locates at the center of the main shaft 108 while the upper end of the first oil supplying path 123 is formed at the outer periphery side of the main shaft 108. In this first embodiment, the first oil supplying path 123 is formed by inclining by three degrees with respect to the central rotational axis of the main shaft 108. Structured as such, when the main shaft 108 rotates, the lubricant oil 106 ascends through the first oil supplying path 123 by centrifugal force. In addition, since the second oil supplying path 124 is also formed in an inclined manner, centrifugal force acts on the lubricant oil 106 by the rotational motion of the crank shaft 107, thereby to ascend the lubricant oil 106 through the second oil supplying path 124.

On the outer periphery of the main shaft 108, a spiral groove 125 is formed in a manner that it upwardly inclines in a direction reverse to the rotational direction of the crank shaft 107. A viscous pump part 126 is formed by combining the spiral groove 125 with the inner periphery of the main shaft bearing 117. The lower end of the spiral groove 125 communicates with the upper end or its vicinity of the first oil supplying path 123, while the upper end of the spiral groove 125 communicates with the lower end or its vicinity of the second oil supplying path 124. On the lower end of the main shaft 108, there is provided an oil pump 127 whose one end opens in the lubricant oil 106 and the other end communicates with the first oil supplying path 123.

As shown in FIG. 2, on the outer periphery of the main shaft 108 of the crank shaft 107, there are provided two sliding sections 130, 131 being in sliding engagement with the main shaft bearing 117 and two non-contact sliding-sections 132, 133 which do not contact with the main shaft bearing 117. The lower end of the spiral groove 125 is located at the non-contact sliding-section 133 beneath the sliding section 130. The diameter gap between the main shaft 108 and the main shaft bearing 117 at the non-contact sliding-section 133, where the lower end of the spiral groove 125 locates, is set to a range between 0.05 mm and 0.40 mm. The diameter gap means the difference of the inner diameter of the shaft bearing 117 and the outer diameter of the main shaft 108. In the first embodiment, the diameter gap at the non-contact sliding-section 133 is set to 0.20 mm. The diameter gap between the main shaft 108 and the main shaft bearing 117 at the sliding sections 130, 131 is set to be in a range between 0.01 mm and 0.03 mm. In the first embodiment, the diameter gap at the sliding sections 130, 131 is set to 0.02 mm.

In addition, a refrigerant gas, used in the hermetic-type compressor of the first embodiment, is natural refrigerant having a low global warming coefficient represented by R134a or R600a whose ozone destruction coefficient is zero. The hydrocarbon refrigerants being these natural refrigerants are used respectively by combining with a lubricant oil having a high relative solubility.

The operation of the hermetic-type compressor of the first embodiment structured as described above will be hereinafter described.

By the rotational movement of the rotor 103 of the electric motor part 104, the crank shaft 107 rotates and its crank part 109 performs a rotational movement about the center axis of the main shaft 108. The rotational movement of the crank part 109 is converted into a reciprocating movement by the connecting rod 122 and is transmitted to the piston 121. As a result, the piston 121 performs a reciprocating sliding motion in the compressing chamber 116, thereby to suck the refrigerant gas to compress it in the compressing chamber 116. In this manner, after the refrigerant gas is sucked from the refrigerating system to the compressing chamber 116 and is compressed, it is exhausted outside the hermetically sealed container 101 for a further circulation through the refrigerating system, again.

The oil pump 127 provided at the lower end of the crank shaft 107 performs a pumping action of pumping up the lubricant oil 106 with the rotation of the crank shaft 107. Partition plates are provided inside the oil pump 127, which has a structure that the rotation of the crank shaft 107 lets these partition plates suck the lubricant oil 106 while stirring the lubricant oil 106. By the pumping action of the oil pump 127, the lubricant oil 106 reserved at the bottom of the hermetically sealed container 101 ascends through the first oil supplying path 123 inside the main shaft 108. In addition, since the first oil supplying path 123 is formed in a manner of being inclined with respect to the rotational center axis of the main shaft 108, the lubricant oil 106 ascends through the first oil supplying path 123 by centrifugal force with the rotation of the main shaft 108. The lubricant oil 106 reached to the upper part of the first oil supplying path 123 is led to the spiral groove 125. Since the spiral groove 125 inclines to the same direction as that of the centrifugal force which works in reverse manner to the rotational direction of the crank shaft 107, the spiral groove 125 functions as a viscous pump 126, thereby to give a great upward transporting force to the lubricant oil 106 inside the groove 125. As a result, the lubricant oil 106 ascends through the groove 125 and is supplied to the sliding sections 130, 131 of the crank shaft 107. The lubricant oil 106 reached to the upper end of the groove 125 is led to the second oil supplying path 124 and is supplied to the crank part 109 and the sliding parts and components in the compressor part 105.

In the hermetic-type compressor in accordance with the first embodiment, minute dust and refuses sucked up by the oil pump 127 with the lubricant oil 106 ascend through the first oil supplying path 123 by the centrifugal force. And, at the upper end or its vicinity of the first oil supplying path 123, the minute dust and refuses are thrown away by the centrifugal force to the lower end of the spiral groove 125 formed on the outer periphery of the main shaft 108. However, the lower end of the spiral groove 125 is formed at the non-contact sliding-section 133 of the main shaft 108, and the gap at the non-contact sliding-section 133 is wider than the diameters of minute dust and refuses, thus the gap in this section hardly clogged with the minute dust and refuses. The minute dust and refuses sucked up together with the lubricant oil 106 therefore drop through the wide gap between the non-contact sliding-section 133 and the main shaft bearing 117.

As described above, in the oil supplying operation, even if the minute dust and refuses sucked up together with the lubricant oil 106 stagnate around the lower end of the groove 125 and enter into the gap between the main shaft 108 and the main shaft bearing 117 at the non-contact sliding-section 133, they are exhausted from the end of the main shaft bearing 117 by the gravity without stagnating there.

In addition, in the hermetic-type compressor structured according to the first embodiment, it is possible to set the distance (lift) from the oil surface of the lubricant oil 106 reserved in the bottom of the hermetically sealed container 101 to the lower end of the groove 125 to be short. Therefore, since the lift of the hermetic-type compressor according to the first embodiment can be short, it is possible to increase the oil supplying amount of the oil pump 127 with the same rotational frequency.

Further, the hermetic-type compressor according to the first embodiment has a structure that the opening of the lower end of the spiral groove 125 occupies a relatively large area and is formed at the non-contact sliding-section 133 of the main shaft 108, but is not formed at the sliding section 130. Therefore, it has a structure in which the lubricant oil is certainly held in the gap between the sliding section 130 and the main shaft bearing 117, and an oil film easily formed between the sliding section 130 and the main shaft bearing 117. As a result, an occasion of contacting the siding section 130 directly with the main shaft bearing 108 as a metal-to-metal contact is surely prevented.

Therefore, with the hermetic-type compressor according to the first embodiment, it is possible to exhaust the minute dust and refuses in the lubricant oil 106 almost completely from the inside of the main shaft bearing 117, to supply the lubricant oil 106 to the sliding parts and components with stability, and to form an oil film easily. Therefore, the hermetic-type compressor according to the first embodiment can realize a smooth sliding movement and can provide a hermetic-type compressor having a high efficiency and reliability.

As mentioned above, in the hermetic-type compressor of the first embodiment, since foreign matters are prevented from entering into the sliding portions and thus damaging the sliding portions by abrasion, it is possible to build a refrigerating system having a high reliability. Since there is no need for increasing the driving force due to the entering of the foreign matters to the sliding portions, the hermetic-type compressor of the first embodiment will not invite the increase in the input power and thus it is possible to constantly realize an operation at a high efficiency.

In the hermetic-type compressor according to the first embodiment, the diameter gap between the main shaft 108 and the main shaft bearing 117 at the non-contact sliding-section 133 where the lower end of the groove 125 is formed is set to be in a range between 0.05 mm and 0.40 mm. When the diameter gap at the non-contact sliding-section 133 is set wider than the above-mentioned range, a problem arises that the lubricant oil 106 would leak downwards from the lower end of the main shaft bearing 117. However, if the diameter gap at the non-contact sliding-section 133 is set to that within the above-mentioned range, the lubricant oil 106 does not easily leak from the main shaft bearing 117. Therefore, it is possible to sufficiently perform the oil supplying operation to the main shaft 108 above the non-contact sliding-section 133 and the sliding portions at the crank part 109.

On the other hand, when the gap at the non-contact sliding-section 133 is set narrower than the above-mentioned range, the viscous friction of the lubricant oil 106 in the non-contact sliding-section 133 is made larger and an increase in the input power is required. However, by setting the gap at the non-contact sliding-section 133 to that within the above-mentioned range, the viscous friction of the lubricant oil 106 in the non-contact sliding-section 133 is made small and it is possible to make the input power small. In other words, in the hermetic-type compressor according to the first embodiment, it is possible to perform a sufficient oiling to the main shaft 108 above the non-contact sliding-section 133 and the sliding portions at the crank part 109, and to realize a reduction in the input power by decreasing the viscous friction of the lubricant oil 106 in the non-contact sliding-section 133. Therefore, the hermetic-type compressor according to the first embodiment becomes an apparatus having a high reliability which works at a high efficiency.

In addition, in the case where the hermetic-type compressor according to the first embodiment is driven by an inverter at low driving frequencies not larger than the power frequency, and when the minute dust and refuses are thrown away to the peripheral side by centrifugal force at the vicinity of the lower end of the spiral groove 125, they may reach to the lower end part of the groove 125 by the gravity, because the flow velocity of the lubricant oil 106 is slow. However, since the minute dust and refuses drop through the gap at the non-contact sliding-section 133, the minute dust and refuses will not stagnate in the sliding portion, and thus it is possible to realize an operation with a high efficiency and reliability even in the low-speed operation.

Further, in the hermetic-type compressor according to the first embodiment, the lower end of the spiral groove 125 being connected to the first oil supplying path 123 is formed in the non-contact sliding-section 133 beneath the sliding section 130 serving as a bearing. Since the lift (distance) from the lubricant oil 106 at the bottom of the hermetically sealed container 101 to the lower end of the groove 125 can therefore be set short, and thus, a low-speed operation is made possible. Therefore, with the hermetic-type compressor according to the first embodiment, it is possible to reduce the compression load at a low driving frequency and the input power to the hermetic-type compressor, and thus to reduce the power consumption in the refrigerating cycle of the refrigerators and the like.

In addition, the above-described operation in the hermetic-type compressor according to the first embodiment is universal regardless of the types of the refrigerant gas and the lubricant to be combined with the refrigerant gas.

Second Embodiment

Figure 3:
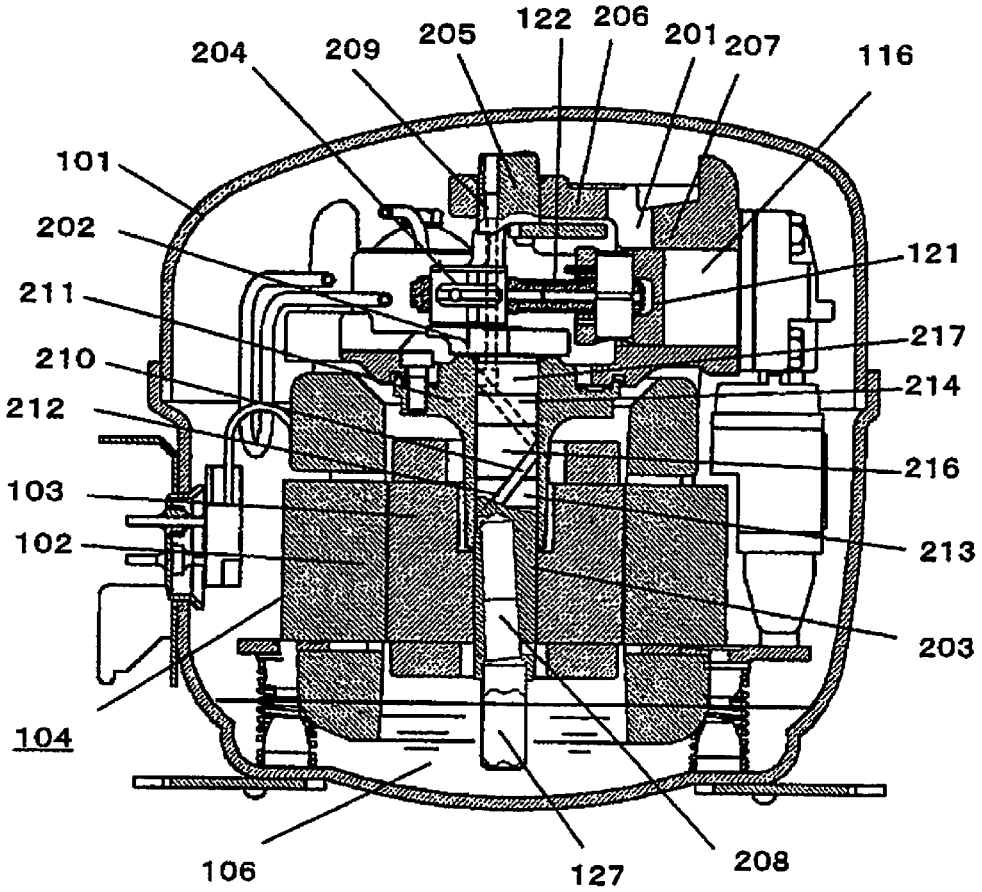
FIG. 3 is a longitudinal cross-sectional view illustrating an inner structure of the hermetic-type compressor of a second embodiment according to the present invention.
Figure 4:
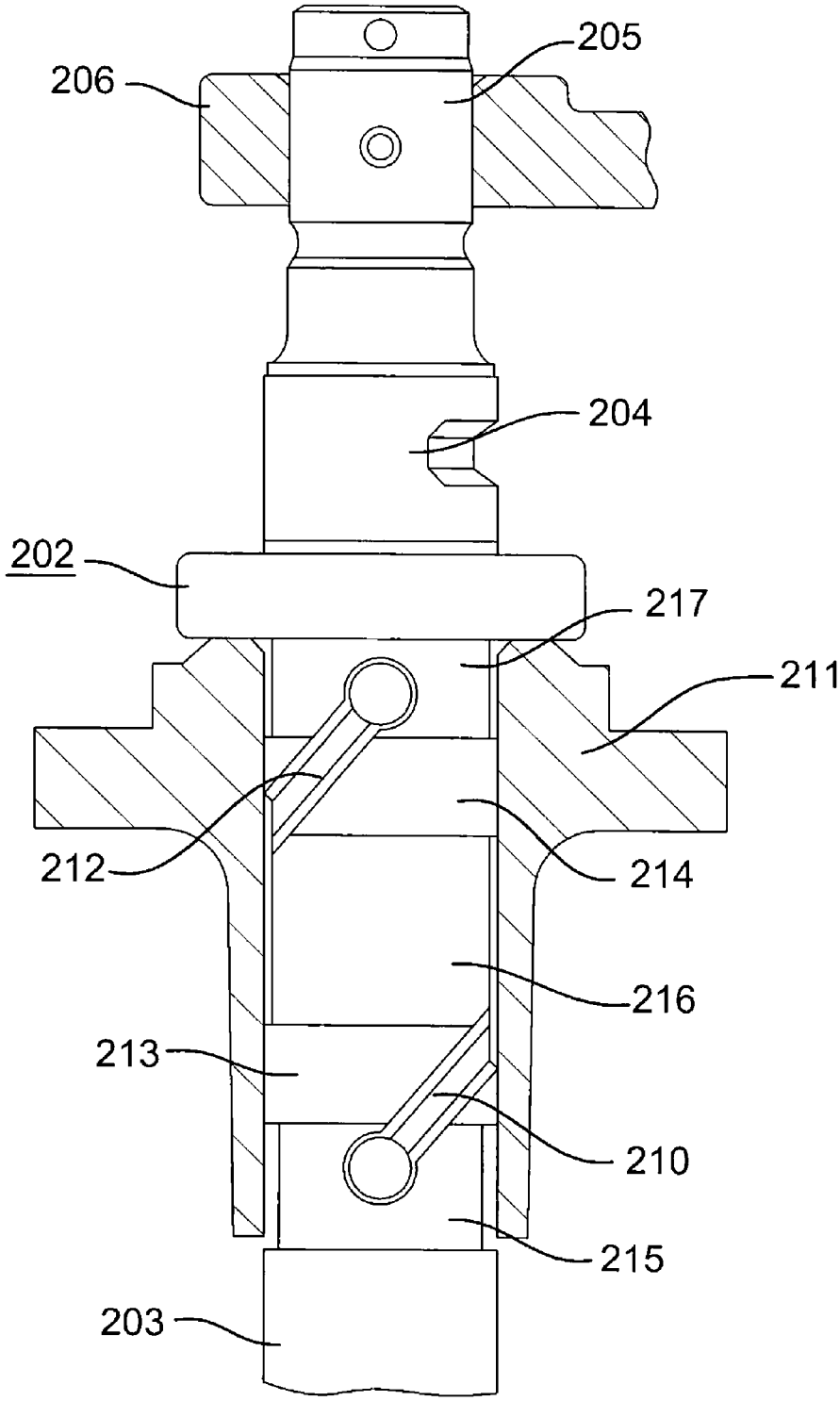
FIG. 4 is a cross-sectional view showing a relevant part of the hermetic-type compressor of the second embodiment.

A hermetic-type compressor according to a second embodiment of the present invention will be hereinafter described referring to FIG. 3 and FIG. 4 of the appended drawings. FIG. 3 is a longitudinal cross-sectional view illustrating an inner structure of the hermetic-type compressor of the second embodiment according to the present invention. FIG. 4 is a cross-sectional view showing a relevant part of the hermetic-type compressor of the second embodiment. In the second embodiment, parts and components having the same function and structure as those in the above-mentioned the first embodiment are denoted by the same reference numerals and the descriptions thereof are omitted. The different points in the structure of the hermetic-type compressor of the second embodiment from that in the hermetic-type compressor of the first embodiment are the structure of the crank shaft and the mechanism for rotatably supporting the crank shaft.

As shown in FIG. 3, the electric motor part 104 being comprised of the stator 102 and the rotor 103 and a compressor part 201 to be driven by this electric motor part 104 are provided in the hermetically sealed container 101 which reserves the lubricant oil 106.

A crank shaft 202 comprises a main shaft 203 around which the rotor 103 is press-fit to be fixed, a crank part 204 provided on an axis eccentric to the main shaft 203 so as to rotate eccentrically around the center axis of the main shaft 203, and an auxiliary shaft 205 provided for sandwiching the crank part 204 between the auxiliary shaft 205 and the main shaft 203. The auxiliary shaft 205 is provided so that it rotates about an axis being coaxial with the main shaft 203. An auxiliary bearing 206 for rotatably supporting the auxiliary shaft 205 is provided on a cylinder block 207.

Inside the crank shaft 202 there are provided a first oil supplying path 208 and a second oil supplying path 209. The first oil supplying path 208 being inside of the lower end of the main shaft 203 is provided in an inclined manner. Namely, the lower end of the first oil supplying path 208 locates at the center of the main shaft 203 while the upper end of the first oil supplying path 208 is formed at the outer periphery side of the main shaft 208. In the second embodiment, the first oil supplying path 203 is formed by inclining by three degrees with respect to the center axis of rotation of the main shaft 203. Structured as such, when the main shaft 203 rotates, the lubricant oil 106 ascends through the first oil supplying path 208 by centrifugal force. On the outer periphery of the main shaft 203, a spiral groove 210 is formed in a manner that it upwardly inclines in a direction reverse to the rotational direction of the crank shaft 202. A viscous pump part 212 is formed by combining the spiral groove 210 with the inner periphery of the main shaft bearing 211. The lower end of the spiral groove 210 communicates with the upper end or its vicinity of the first oil supplying path 208, while the upper end of the spiral groove 210 communicates with the lower end or its vicinity of the second oil supplying path 209. On the lower end of the main shaft 203, there is provided an oil pump 127 whose one end opens in the lubricant oil 106 and the other end communicates with the first oil supplying path 208.

As shown in FIG. 4, on the outer periphery of the main shaft 203 of the crank shaft 202, there are provided two sliding sections 213, 214 which slide with the main shaft bearing 211 and three non-contact sliding-sections 215, 216, 217 which do not contact with the main shaft bearing 211. The lower end of the spiral groove 210 is located at the first non-contact sliding-section 215 beneath the first sliding section 213. The upper end of the groove 210 is located at the third non-contact sliding-section 217 above the second sliding section 214.

The diameter gap between the main shaft 203 and the main shaft bearing 211 at the first non-contact sliding-section 215 where the lower end of the spiral groove 210 are formed is set to be in a range between 0.05 mm and 0.40 mm. In the second embodiment, the diameter gap at the first non-contact sliding-section 215 is set to 0.20 mm. The diameter gaps between the main shaft 203 and the main shaft bearing 211 at the second non-contact sliding-section 216 and at the third non-contact sliding-section 217 are set to be in a range between 0.05 mm and 0.40 mm. In the second embodiment, the diameter gaps at the second non-contact sliding-section 216 and at the third non-contact sliding-section 217 are set to 0.4 mm.

The diameter gaps between the main shaft 203 and the main shaft bearing 211 at the first sliding sections 213 and at the second sliding section 214 are set to be in a range between 0.01 mm and 0.03 mm. In the second embodiment, the diameter gaps at the first sliding section 213, and at the second sliding section 214 are set to 0.02 mm.

In the hermetic-type compressor according to the second embodiment, the auxiliary shaft 205 is formed on the top end part of the crank shaft 202 and this auxiliary shaft 205 is rotatably supported by the auxiliary bearing 206. Namely, the crank shaft 202 is rotatably supported at its main shaft 203 by the main shaft bearing 211 and the auxiliary shaft 205 formed above the crank part 204 being coaxial with the main shaft 203 is rotatably supported by the auxiliary bearing 206. It is preferable to set the diameter gap between the outer periphery of the auxiliary shaft 205 and the inner periphery of the auxiliary bearing 206 to be in a range between 0.01 mm and 0.03 mm. In the hermetic-type compressor according to the second embodiment, the diameter gap is set to 0.02 mm.

The refrigerant gas used in the hermetic-type compressor according to the second embodiment, is natural refrigerant with a low warming coefficient represented by R134a or R600a having an ozone destruction coefficient being zero. The hydrocarbon refrigerant of these natural refrigerants is used by combining with a lubricant oil having a high relative solubility, respectively.

The operation of the hermetic-type compressor according to the second embodiment structured as described above will be hereinafter described.

By the rotational movement of the rotor 103 of the electric motor part 104, the crank shaft 202 rotates and its crank part 204 on the eccentric axis performs a rotational movement about the center axis of the main shaft 203. The rotational movement of the crank part 204 is converted into a reciprocating movement by the connecting rod 122 to be transmitted to the piston 121. As a result, the piston 121 performs a reciprocating sliding movement in the compressing chamber 116, thereby to suck the refrigerant gas to compress it in the compressing chamber 116. In this manner, after the refrigerant gas is sucked from the refrigerating system to the compressing chamber 116 and is compressed, it is exhausted outside the hermetically sealed container 101 for further circulating through the refrigerating system.

Further, with the rotational movement of the crankshaft 202, the lubricant oil 106 reserved in the bottom part of the hermetically sealed container 101 is sucked up by pumping actions of the oil pump 127 and of the viscous pump 212 and the like, and supplied to the sliding sections of the crank shaft 202 and to the sliding portions in the compressor part 201. As described in the above, the operation of the hermetic-type compressor according to the second embodiment is the same as the operation of the hermetic-type compressor according to the first embodiment, which has been disclosed before. In the hermetic-type compressor according to the second embodiment, since the second oil supplying path 209 passes through the auxiliary shaft 205, the lubricant oil which has passed through the second oil supplying path 209 supplied to the gap between the auxiliary shaft 205 and the auxiliary bearing 206.

In the hermetic-type compressor according to the embodiment 2, and at the part where the main shaft 203 is supported by the main shaft bearing 211, the first non-contact sliding-section 215 and the third non-contact sliding-section 217 are formed on the both sides of the part. Further, at the crank shaft 202, the crank part 204 which rotates eccentrically about the center axis is provided at the upper part of the main shaft 203. Therefore, in the case where the hermetic-type compressor according to the second embodiment is structured so that the crank shaft 202 is supported only by the main shaft bearing 211 without the auxiliary shaft 205 and the auxiliary bearing 206, there is a possibility of the main shaft 203 to incline largely with the rotational movement of the crank shaft 202. In such a case, there is a possibility of occurring such problems as pinching or wrenching in the sliding portions of the crank part 204 and the compressor part 201. The hermetic-type compressor of the second embodiment is structured so that the main shaft 203 and the auxiliary shaft 205 on both the lower end and the upper end of the crank part 204 are rotatably supported by the main shaft bearing 211 and the auxiliary bearing 206, respectively. For that reason, during the rotational movement of the crank shaft 202, the main shaft 203 is certainly held at its desired position to rotate, and any malfunction such as pinching or wrenching is effectively prevented to occur in the crank part 204 and the sliding portion of the compressor part 201.

As disclosed above, in the hermetic-type compressor according to the second embodiment, since the auxiliary bearing 206 surely regulates the inclination of the crank shaft 202 together with the main shaft bearing 211, it is possible to make the clearance between the first sliding section 213 and the second sliding section 215 of the main shaft 203 smaller as compared with a case wherein there is only the main shaft bearing 211. In addition, in the hermetic-type compressor according to the second embodiment, it is possible to locate the lower end of the spiral groove 210 below the first sliding section 213 and to locate the upper end of the groove 210 above the second sliding section 214. With this structure, in the first sliding section 213 at the lower side and in the second sliding section 214 at the upper side, it is possible to greatly reduce the entering of the minute dust and refuses into these sliding portions. Therefore, with the hermetic-type compressor according to the second embodiment, it is possible to prevent the lowering of the reliability due to the damage and the like at the sliding sections 213, 214 and to increase the efficiency and the reliability.

In addition, in the hermetic-type compressor of the second embodiment, at the first non-contact sliding-section 215 below the first sliding section 213 serving as a bearing, the lower end of the spiral groove 210 to be connected with the first oil supplying path 208 is formed. It is therefore possible to set lift (distance) from the surface of the lubricant oil 106 reserved in the bottom of the hermetically sealed container 101 to the lower end of the groove 210 to be short, and thus a low-speed operation is made possible. In this manner, according to the hermetic-type compressor of the second embodiment, it is therefore possible to reduce the compressing load at the low driving frequency, to reduce the input power to the hermetic-type compressor, and thus to reduce the power consumption in the refrigerating cycle in the refrigerators and the like.

In addition, the above-described operation of the hermetic-type compressor according to the second embodiment is universal regardless of the types of the refrigerant gas and the lubricant oil to be combined with the refrigerant gas.

Third Embodiment

Figure 5:
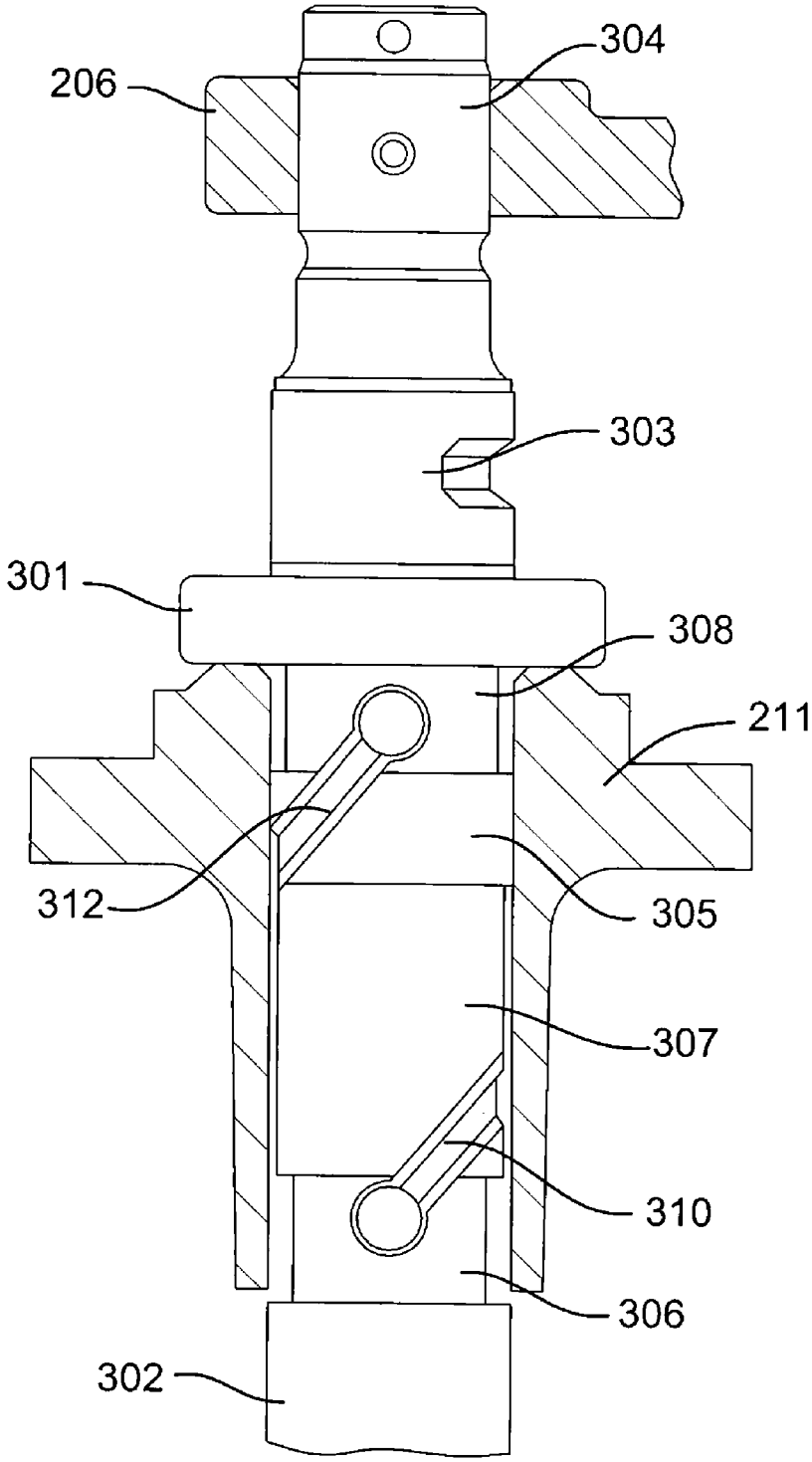
FIG. 5 is a cross-sectional view showing a relevant part of the hermetic-type compressor of a third embodiment according to the present invention.
Figure 6:
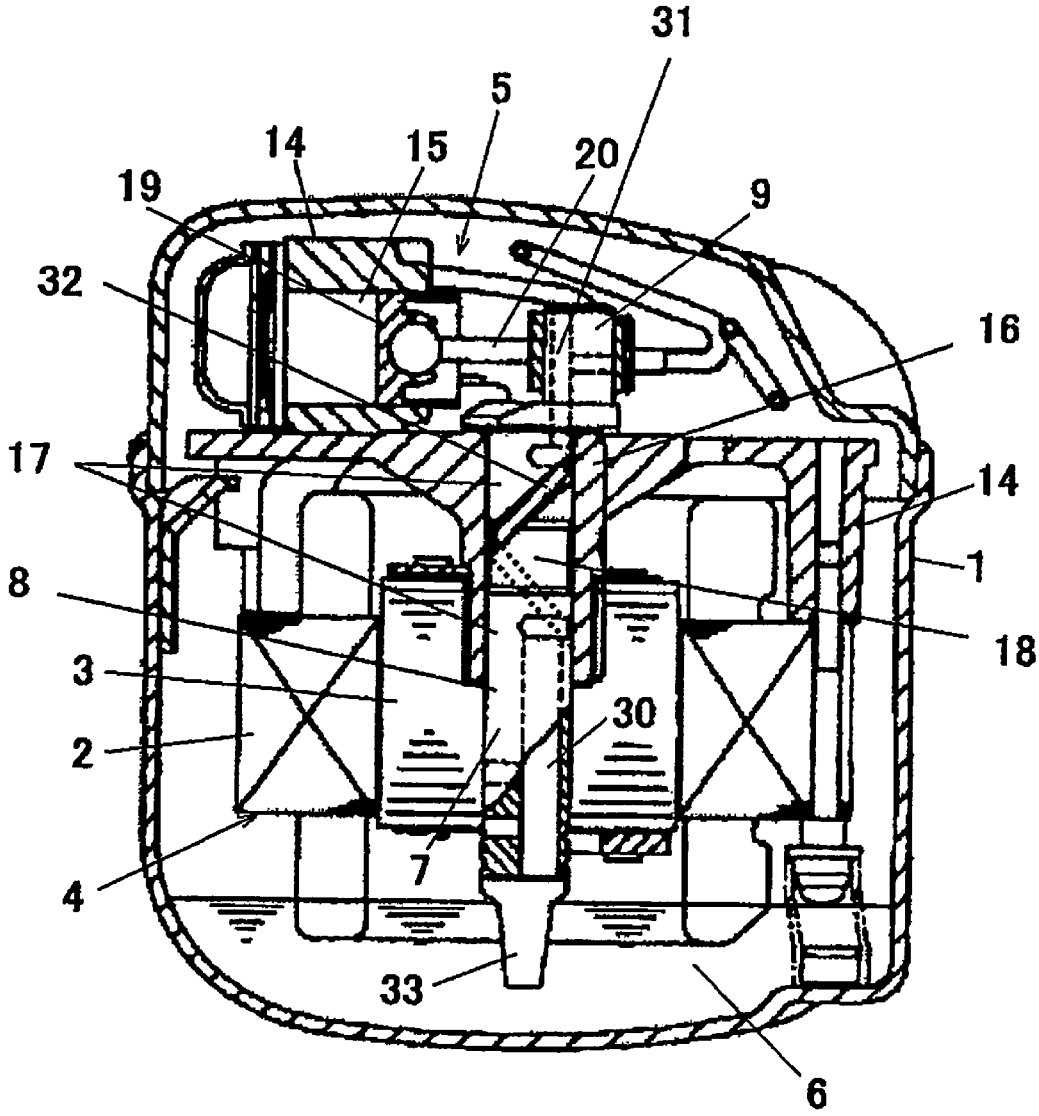
FIG. 6 is the longitudinal cross-sectional view illustrating an inner structure of the conventional hermetic-type compressor.

A hermetic-type compressor according to a third embodiment of the present invention will be hereinafter described referring to FIG. 5 of the appended drawings. FIG. 5 is a cross-sectional view showing a relevant part of the hermetic-type compressor of the third embodiment. In the third embodiment, parts and components having the same function and structure as those in the above-mentioned the second embodiment are denoted by the same reference numerals and the descriptions thereof are omitted. The different point in the structure of the hermetic-type compressor of the third embodiment from those in the hermetic-type compressor of the second embodiment is the structure of the crank shaft. In the following description on the third embodiment, the points different from the second embodiment will be mainly described.

As shown in FIG. 5, a crank shaft 301 comprises a main shaft 302, a crank part 303 eccentrically formed with respect to the main shaft 302 and, an auxiliary shaft 304 provided coaxially with the main shaft 302 for sandwiching the crank part 303. On the outer periphery of the main shaft 302, there are provided a sliding section 305 which slides with the main shaft bearing 211 and three non-contact sliding-sections 306, 307, 308 which do not contact with the main shaft bearing 211. Namely, the main shaft 302 is in a sliding engagement with the main shaft bearing 211 at the sliding region 305 only. The lower end of a spiral groove 310 is provided at the first non-contact sliding-section 306 which faces the lower end part of the main shaft bearing 211, and the upper end of the spiral groove 310 is provided at the third non-contact sliding-section 308.

In the third embodiment, on the outer periphery of the main shaft 302, there are formed the first non-contact sliding-section 306, the second non-contact sliding-section 307, the sliding section 305 and the third non-contact sliding-section 308 in this order from the lowest. In the thus-formed non-contact sliding-sections, the diameter gap between the first non-contact sliding-section 306 and the main shaft bearing 211 is about 0.20 mm, and the diameter gap between the second non-contact sliding-section 307 and the main shaft bearing 211 is 0.50 mm. Further, the diameter gap between the third non-contact sliding-section 308 and the main shaft bearing 211 is 0.50 mm.

The operation of the hermetic-type compressor according to the third embodiment structured as mentioned above is the same as that of the above-mentioned hermetic-type compressor of the first embodiment. In the hermetic-type compressor according to the third embodiment, since the second oil supplying path 209 passes through the auxiliary shaft 304 as in the case of the second embodiment, the lubricant oil 106 passed through the second oil supplying path 209 is supplied to the gap between the auxiliary shaft 304 and the auxiliary bearing 206.

In the above-mentioned hermetic-type compressor according to the second embodiment, since the sliding sections 213, 214 are formed at the two locations, the upper ends and the lower ends of the respective sliding sections 213, 214 are located at 4 points. At the respective upper and lower ends of the sliding sections 213, 214, the oil pressure between the sliding sections 213, 214 and the main shaft 211 easily escapes and thus oil films are not easily formed therein. Therefore, such sliding portions are preferably gathered in one area. In the hermetic-type compressor according to the third embodiment, since the sliding section 305 is at one location, the upper and lower ends of the sliding region 305 are located at two points. Therefore, the number of locations through which the inside oil pressure escapes made small, and thus the oil film are easily formed.

As mentioned above, in the hermetic-type compressor according to the third embodiment, since the sliding points can be made minimum and the area of the part occupied by the sliding portion can also be made small, it is possible to reduce the sliding loss and improve the efficiency.

In the hermetic-type compressor of the third embodiment, the diameter gap between the first non-contact sliding-section 306 and the main shaft bearing 211 is set, for instance, to 0.20 mm, and the diameter gap between the second non-contact sliding-section 307 and the main shaft bearing 211 is set, for instance, to 0.50 mm. As described above, by setting the diameter gap at the first non-contact sliding-section 306 smaller than the diameter gap at the second non-contact sliding-section 307, it is so structured that the lubricant oil 106 supplied above the first non-contact sliding-section 306 does not easily leak downwards from the first non-contact sliding-section 306. Therefore, it is possible to perform a sufficient oil supplying to the sliding section 305, located above the main shaft 302, and to the sliding portion as the crank part 303 and the like. In addition, since the gap at the second non-contact sliding-section 307 is set to sufficiently large, it is possible to make the viscous friction of the lubricant oil 106 in the gap at the second non-contact sliding-section 307 sufficiently small.

As mentioned above, in the hermetic-type compressor according to the third embodiment, it is possible to perform a sufficient oiling to the sliding portion at the main shaft 302 above the first non-contact sliding-section 306, the crank part 303 and the like, and thus to reduce the input power by making the viscous friction of the lubricant oil 106 in the gap at the non-contact sliding-section 307 small. As a result, the hermetic-type compressor in accordance with the third embodiment becomes an apparatus having a high efficiency and a high reliability.

The operation of the above-mentioned hermetic-type compressor in accordance with the third embodiment is universal regardless of the types of the refrigerant gas and the lubricant oil to be combined with the refrigerant gas.

As described in the above-mentioned embodiments, according to the present invention, it is possible to provide a hermetic-type compressor having a high efficiency and reliability, by effectively preventing the decrease in the efficiency due to the increase in the input power and preventing the decrease in the reliability attributable to the damage and abrasion on the sliding portions.

Although the invention has been described in its preferred form with a certain degree of particularity, it is understood that the present disclosure of the preferred form has been changed in the details of construction and the combination and arrangement of parts may be resorted to without departing from the spirit and the scope of the invention as claimed.

INDUSTRIAL APPLICABILITY

Since the present invention can provide a hermetic-type compressor being able to prevent the lowering in the efficiency attributable to the increase in the input power as well as to prevent the lowering in the reliability attributable to the damage and abrasion of the sliding portions, it is useful in the refrigerating cycle for the refrigerators, the air-conditioners and the like.

The invention claimed is:

1. A hermetic-type compressor including an electric motor part and a compressor part to be driven by said electric motor part both enclosed in a hermetically sealed container which reserves a lubricant oil, wherein:

said compressor part comprises a crank shaft having a crank part and a main shaft, which has an axis of rotation in a perpendicular direction, and a main shaft bearing for rotatably supporting said main shaft;

a viscous pump is comprised by combining a groove, at least part of which being spiral, formed on the outer periphery of said main shaft, with the inner periphery of said main shaft bearing;

said main shaft has a sliding section being in a sliding engagement with said main shaft bearing and a non-contact sliding-section configured to have a gap with the inner periphery of said main shaft bearing so as to not contact with the main shaft bearing, on the outer periphery of said main shaft which faces said main shaft bearing, said sliding section and said at non-contact sliding-section are coaxial about a central axis of said main shaft, said sliding section has a first outside diameter, said non-contact sliding-section has a second outside diameter, said second outside diameter is less than said first outside diameter, and said first outside diameter and said second outside diameter are coaxial about said central axis of said main shaft;

inside said main shaft, at least one oil supplying path is formed by inclining with respect to the central axis of the main shaft, a lower end of said at least one oil supplying path communicates with an oil pump which is provided at the lower end of the main shaft to perform a pumping action of pumping up the lubricant oil with the rotation of the main shaft;

the lower end of said groove is arranged at said non-contact sliding-section beneath said sliding section where said main shaft slides with said main shaft bearing, and the lower end of said groove communicates with an upper opening end of said at least one oil supplying path on the non-contact sliding section; and the gap between said main shaft and said main shaft bearing at said non-contact sliding-section which makes to communicate with between the lower end of said groove and the upper opening end of said at least one oil supplying path is within a range between 0.05 mm and 0.40 mm.

2. The hermetic-type compressor in accordance with claim 1, wherein a plurality of non-contact sliding-sections, including said non-contact sliding section, are formed on a face of the outer periphery of said main shaft opposing to said main shaft bearing with a gap between said main shaft and said main shaft bearing, where said non-contact sliding-section at the lowermost position along the main shaft is formed with a gap narrower than the gaps between said main shaft and said main shaft bearing at the other non-contact sliding-sections.

3. The hermetic-type compressor in accordance with claim 1, wherein the upper end of said groove is arranged at said non-contact sliding-section above said sliding section where said main shaft slides with said main shaft bearing.

4. The hermetic-type compressor in accordance with claim 3, wherein the gap between said main shaft and said main shaft bearing at said non-contact sliding-section arranged at the upper end of said groove is within a range between 0.05 mm and 0.50 mm.

5. The hermetic-type compressor in accordance with claim 1, further comprising an auxiliary shaft being coaxial with said main shaft for sandwiching the crank part, and an auxiliary shaft bearing rotatably supporting said auxiliary shaft.

6. The hermetic-type compressor in accordance with claim 5, wherein one sliding section of said main shaft with said main shaft bearing is formed on the face of the outer periphery of said main shaft.

7. The hermetic-type compressor in accordance with claim 1, said hermetic-type compressor is driven by an inverter at a plurality of driving frequencies including at least a driving frequency not greater than a power frequency.

8. The hermetic-type compressor in accordance with claim 2, said hermetic-type compressor is driven by an inverter at a plurality of driving frequencies including at least a driving frequency not greater than a power frequency.

9. The hermetic-type compressor in accordance with claim 3, said hermetic-type compressor is driven by an inverter at a plurality of driving frequencies including at least a driving frequency not greater than a power frequency.

10. The hermetic-type compressor in accordance with claim 4, said hermetic-type compressor is driven by an inverter at a plurality of driving frequencies including at least a driving frequency not greater than a power frequency.

11. The hermetic-type compressor in accordance with claim 5, said hermetic-type compressor is driven by an inverter at a plurality of driving frequencies including at least a driving frequency not greater than a power frequency.

12. The hermetic-type compressor in accordance with claim 6, said hermetic-type compressor is driven by an inverter at a plurality of driving frequencies including at least a driving frequency not greater than a power frequency.

* * * * *

UNITED STATES PATENT AND TRADEMARK OFFICE

CERTIFICATE OF CORRECTION

PATENT NO. : 7,832,994 B2
APPLICATION NO. : 10/570772
DATED : November 16, 2010
INVENTOR(S) : Hironari Akashi et al.

It is certified that error appears in the above-identified patent and that said Letters Patent is hereby corrected as shown below:

In column 15, line 23, claim 1, “and said at non-contact” should read -- and said non-contact --

Signed and Sealed this
Twelfth Day of April, 2011

David J. Kappos

David J. Kappos
*Director of the United States Patent and Trademark Office*